US006220480B1

(12) United States Patent
Stankus et al.

(10) Patent No.: US 6,220,480 B1
(45) Date of Patent: Apr. 24, 2001

(54) DISPENSER

(75) Inventors: Philip Stankus, Coldwaltham; Paul Gocher, Billingshurst, both of (GB)

(73) Assignee: A. Nelson & Co. Ltd. (GB)

( * ) Notice: Subject to any disclaimer, the term of this patent is extended or adjusted under 35 U.S.C. 154(b) by 0 days.

(21) Appl. No.: 09/341,091

(22) PCT Filed: Jan. 9, 1998

(86) PCT No.: PCT/GB98/00059

§ 371 Date: Jul. 2, 1999

§ 102(e) Date: Jul. 2, 1999

(87) PCT Pub. No.: WO98/30468

PCT Pub. Date: Jul. 16, 1998

(30) Foreign Application Priority Data

Jan. 10, 1997 (GB) ..... 9700395

(51) Int. Cl.[7] ..... B65G 59/00; B65H 3/00; G07F 11/72

(52) U.S. Cl. ..... 221/151; 221/152; 221/209; 221/246; 221/273

(58) Field of Search ..... 221/151, 152, 221/209, 246, 256, 263, 289, 273

(56) References Cited

U.S. PATENT DOCUMENTS

| | | | | |
|---|---|---|---|---|
| 3,159,308 | * | 12/1964 | Passavanti | 221/263 X |
| 3,269,597 | | 8/1966 | Passavanti . | |
| 3,854,626 | * | 12/1974 | Krechmar | 221/264 X |
| 4,653,668 | | 3/1987 | Gibilisco et al. . | |
| 4,844,295 | * | 7/1989 | Deardorff | 221/263 X |
| 4,887,738 | * | 12/1989 | Jennings et al. | 221/264 X |
| 5,018,644 | * | 5/1991 | Hackmann et al. | 221/152 X |
| 5,405,047 | * | 4/1995 | Passavanti | 221/190 X |

FOREIGN PATENT DOCUMENTS

| | | |
|---|---|---|
| 9 114 688 | 3/1993 | (DE) . |
| 0 051 994 | 5/1982 | (EP) . |
| 0 188 278 | 1/1986 | (EP) . |
| 0 236 039 | 9/1987 | (EP) . |
| 0 290 972 | 11/1988 | (EP) . |
| 2 257 421 | 1/1993 | (GB) . |

* cited by examiner

*Primary Examiner*—Christopher P. Ellis
*Assistant Examiner*—Gene O. Crawford
(74) *Attorney, Agent, or Firm*—Nixon & Vanderhye PC

(57) ABSTRACT

A pill dispenser for dispensing pills is provided that has a container for holding the pills to be dispensed. The container is closed at one end and open at the opposite end. The container is slidably received in a sleeve. The dispenser has an outlet through which a pill can pass from the container and a gate for closing the outlet to prevent a pill from passing through the outlet. The arrangement is such that the gate is opened when the container is moved in the sleeve, so that a pill can pass through the open end of the container to the outlet to be dispensed from the dispenser. The dispenser may be arranged so that one and only one pill is dispensed at a time.

25 Claims, 3 Drawing Sheets

DISPENSER

This application is the national phase of international application PCT/GB98/00059 filed Jul. 9, 1998 which designated the U.S.

The present invention relates to a dispenser.

Various dispensers for dispensing pills are known. It is desirable in some applications for the dispenser to be able to dispense one and only one pill on each operation of the dispenser. Some prior art dispensers do not function reliably in that the dispenser may dispense more than one pill or no pills at all on operation of the dispenser. In addition, with some pills, it is essential or at least desirable for the pills not to be touched so that the pills can be kept clean and sterile.

There is a general need for an improved pill dispenser as many prior art dispensers do not operate reliably and consistently.

According to the present invention, there is provided a pill dispenser for dispensing pills, the dispenser comprising: a container for holding pills, the container being closed at one end and open at an opposite end; and, a sleeve in which the container is slidably received; the dispenser having an outlet through which a pill can pass from the container and a gate for closing the outlet to prevent a pill passing through the outlet; the arrangement being such that the gate is opened when the container is moved in the sleeve so that a pill can pass through the open end of the container to the outlet to be dispensed from the dispenser.

The gate may be carried by the sleeve.

The gate may be a resilient flexible arm.

The dispenser may have a cam which biases the gate to its open position when the container is moved towards the outlet end of the dispenser to allow a pill to pass to and through the outlet.

The dispenser preferably has a stop for preventing second and further pills being dispensed after a first pill has moved past the stop. The stop may be an abutment which projects into the outlet. The stop may be carried by the sleeve so that the stop moves into the outlet when the container is moved in the sleeve towards the outlet end of the dispenser.

The passage from the container to the outlet may be a stepped funnel having a plurality of steps of decreasing diameter from the container to the outlet for example preferably eccentric in cross-sectional shape and may be elliptical or oval for example.

The container may have an external annular rib which is received in an internal retaining groove in the sleeve for movement therein as the container is moved back and forth in the sleeve. The sleeve may have an internal annular recess in which the annular rib may be received when the dispenser is not in use.

For ease of manufacture and assembly, the dispenser may include an outlet plug which is received in the open end of the container. Where a cam is provided, the cam may be carried by the plug. The plug may also carry the stop where provided. The plug may also provide the stepped funnel to the outlet where provided.

The container may include a tube therein. This serves to keep the contents clean and sterile by keeping the contents out of contact with the container. The tube may be glass. Where an outlet plug is provided, the plug may have a first collar received in the tube.

The dispenser may have biasing means for biasing the container away from the outlet. The biasing means may be a resilient return spring carried by the sleeve.

There may be provided a cap for fitting to a neck of the dispenser. The dispenser may be arranged to dispense a pill directly into the cap. This can help to avoid pills being handled by the user.

The pills which can be dispensed from the dispenser of the invention include medicines, homeopathic remedies, vitamins, artificial sweeteners and any other material which can be provided in a pill form.

An embodiment of the present invention will now be described by way of example with reference to the accompanying drawings, in which.

Figure 1:
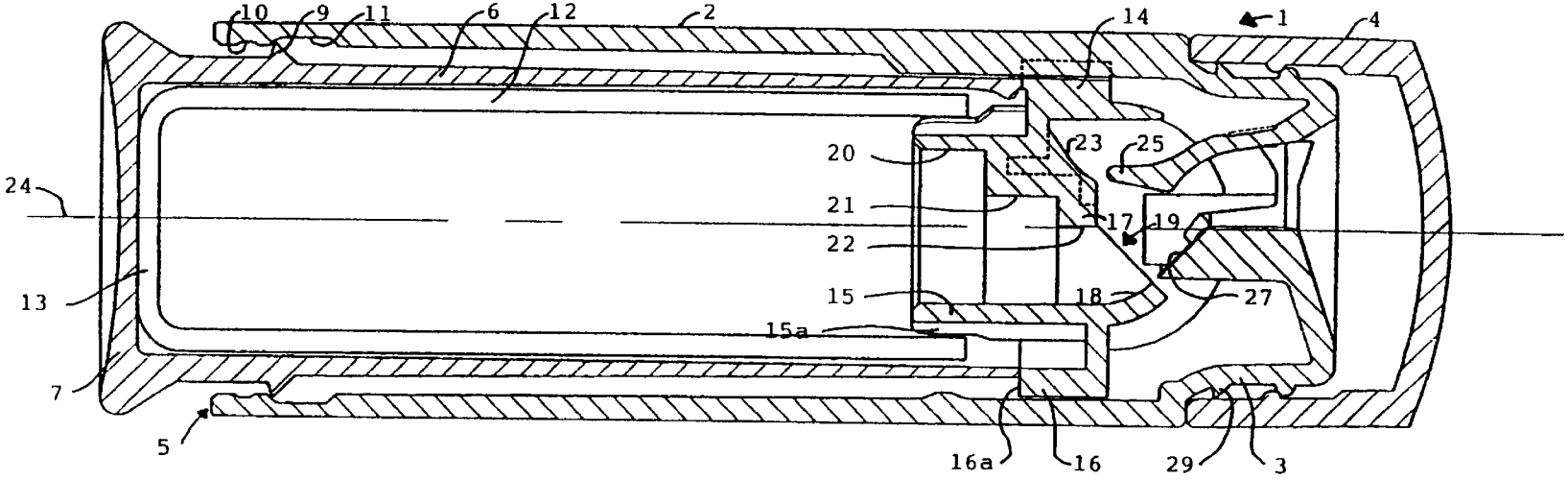
FIG. 1 is a longitudinal cross-sectional view of a first example of a dispenser.
Figure 3A:
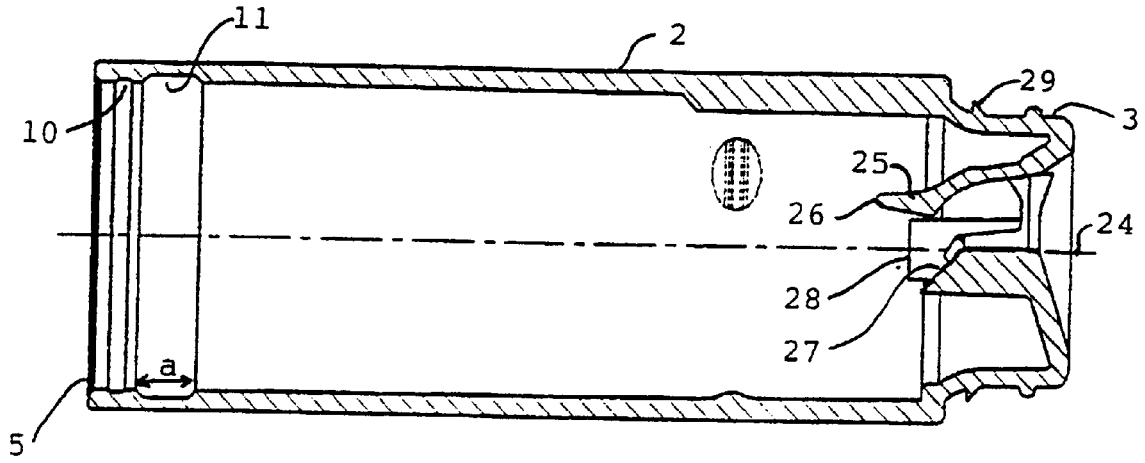
Figure 3B:
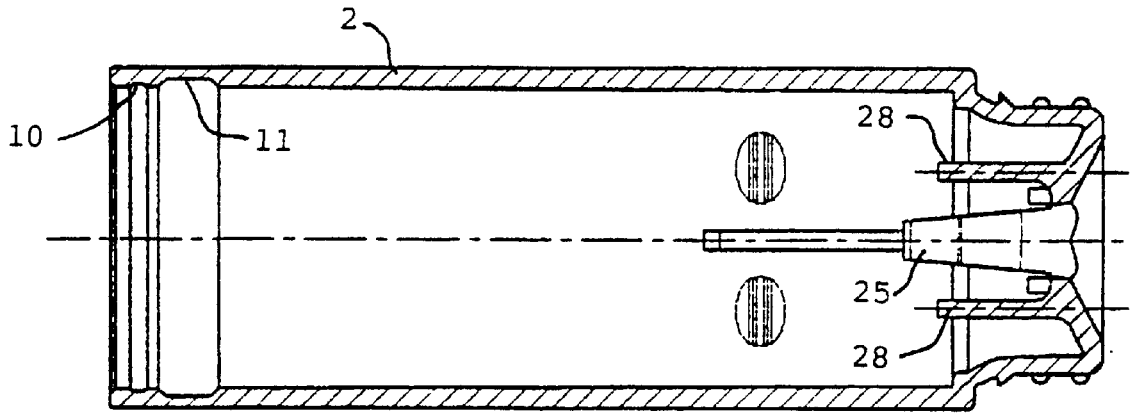

FIG. 3*a* is a longitudinal cross-sectional view of a sleeve of the dispenser of FIG. 1;

FIG. 3*b* is a longitudinal cross-sectional view of the sleeve at a right angle to the sectional view of FIG. 3*a;*

Figure 4A:
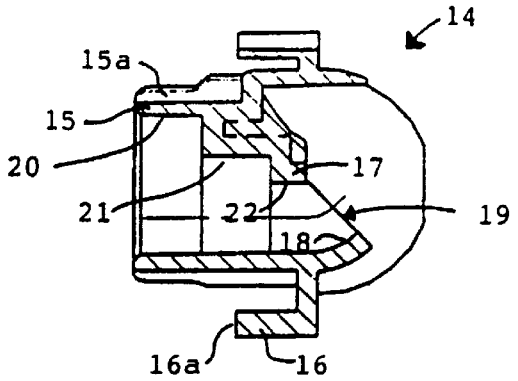
Figure 4B:
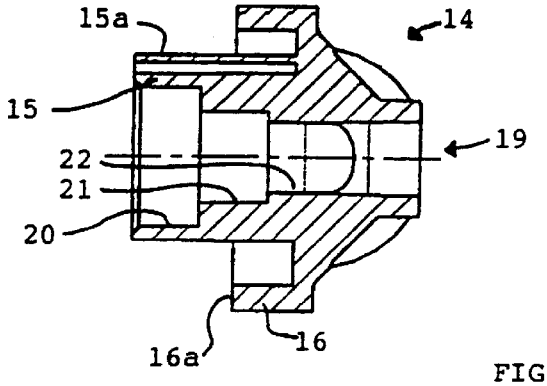
Figure 4C:
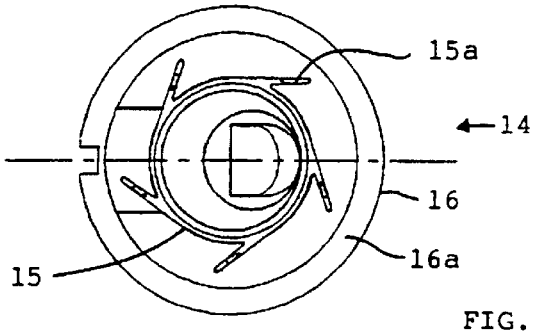
Figure 5:
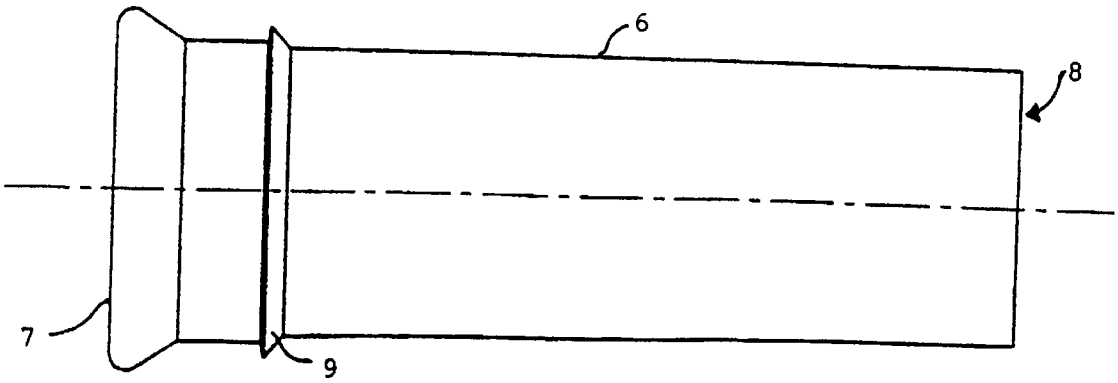

FIG. 4*a* is a longitudinal cross-sectional view of an outlet plug of the dispenser of FIG. 1;

FIG. 4*b* is a cross-sectional view corresponding to FIG. 4*a* at a right angle thereto;

FIG. 4*c* is a view from one end of the outlet plug; and,

FIG. 5 is a side elevation of an operating button of the dispenser of FIG. 1.

A dispenser 1 has a hollow cylindrical sleeve 2 which has a screw-threaded neck 3. A closed cap 4 is provided with a corresponding screw thread so that the cap 4 can be fitted to the neck 3. The sleeve 2 and cap 4 may both be injection moulded plastics such as polypropylene.

The end 5 of the sleeve 2 opposite the neck 3 is open and receives a cylindrical container 6 which acts as an operating button 6 and which may also be injection moulded plastics such as polypropylene. The button 6 is hollow cylindrical and is closed by an end wall 7, the other end 8 of the button 6 being open. The button 6 is received in the sleeve 2 so that the open end 8 of the button 6 is towards the neck 3 of the sleeve 2.

The button 6 has an external annular rib 9 around its circumference towards the closed end 7. The sleeve 2 is provided internally with an annular recess 10 towards its open end 5 which can receive the rib 9 of the button 6. The rib 9 is normally positioned in the recess 10 to seal the dispenser 1 during transit of the dispenser 1. The sleeve 2 also has an inner annular groove 11 near to the annular recess 10 but closer to the neck 3 of the sleeve 2. In use, the button 6 is pushed further into the sleeve 2 so that the annular rib 9 passes out of the transit recess 10 and into the groove 11. Because of the longitudinal extent of the groove 11, the button 6 can move back and forth in the sleeve 2 over a distance corresponding to the longitudinal extent a of the groove 11 with the rib 9 sealing the dispenser 1 by contact with the portion of the sleeve 2 defining the groove 11.

The button 6 contains therein a borosilicate glass tube 12 which has a closed end 13 adjacent the closed end 7 of the button 6. The glass tube 12 serves to keep any pills within the tube 12 sterile by preventing the pills from being contaminated by direct contact with the plastics material from which the button 6 is made.

An outlet plug 14 is slidably received in the sleeve 2. The plug 14 has a first collar 15 which carries five thin flaps or fins 15*a* which project tangentially from the collar 15 and which are resiliently flexible. The fins 15*a* enable the plug 14 to fit in the glass tube 12 to hold the glass tube 12 in position and serve to cushion the glass tube 6 to prevent breakage of the glass tube 6 under adverse shock conditions. The plug 14 has a second, slightly wider collar 16 which fits in the sleeve 2 and which has an end face 16*a* which is a flush fit against the open end 8 of the button 6. In the assembled dispenser 1, the mechanism plug 14 is therefore positioned towards the neck 3 of the sleeve 2 and holds the tube 12 and button 6 in position relative to each other. The mechanism plug 14 may be made of injection moulded plastics such as polypropylene.

The mechanism plug 14 is generally hollow and has an internal projection 17 which projects into the hollow centre of the plug 14 from the wall of the plug 14. The internal projection 17 defines with an opposing part 18 of the wall of the plug 14 an outlet 19 which, as can be seen particularly clearly in FIGS. 1 and 4*a,* is off-centre and which has a diameter or width which corresponds to the diameter or width of a pill to be dispensed from the dispenser 1. The portion 18 of the wall of the plug 14 which defines in part the outlet 19 is curved towards the centre of the plug 14 in the region adjacent the neck 3 of the sleeve 2 so that the outlet 19 curves towards the centre of the dispenser 1 on passing out of the outlet 19.

The plug 14 is further internally moulded so that the passage from the glass tube 12 to the outlet 19 has three steps 20,21,22 having diameters which decrease towards the outlet 19. The steps 20,21,22 preferably have a cross-sectional shape such as circular elliptical or oval and are eccentrically arranged with respect to each other. The three steps 20,21,22 define a stepped funnel which leads towards the outlet 19 from the glass tube 12. The use of a stepped funnel helps to ensure that pills enter the outlet 19 one at a time in single file. If an ordinary smoothly tapered funnel is used as in some prior art dispensers, jamming of the pills on the way to the outlet can occur as stable locking patterns of pills can occur. The use of the steps 20,21,22 of decreasing diameter, of a shape and size which can be tailored to suit the pills to be dispensed, helps to prevent such stable locking patterns of pills occurring.

The internal projection 17 of the plug 14 also carries a curved cam surface 23 facing towards the neck 3 of the sleeve 2, the cam surface 23 moving away from the neck end of the tube 2 when moving radially outwards of the centre line 24 of the dispenser 1.

The neck 3 of the sleeve 2 is formed internally with a gate 25 in the form of a flexible resilient arm 25. The gate 25 projects generally inwardly of the sleeve 2 and towards the centre line 24 of the sleeve 2 from one side of the neck 3. As will be explained further below, the tip 26 of the gate 25 can come into contact with the cam 23 on the mechanism plug 14.

The other side of the neck 3 of the sleeve 2 is formed with an internally projecting abutment surface 27 which faces away from the neck end of the sleeve 2 and which moves away from the neck end of the sleeve 2 when moving radially outwards of the centre line 24 of the dispenser 1 for reasons which will become clear from the following.

Figure 2:
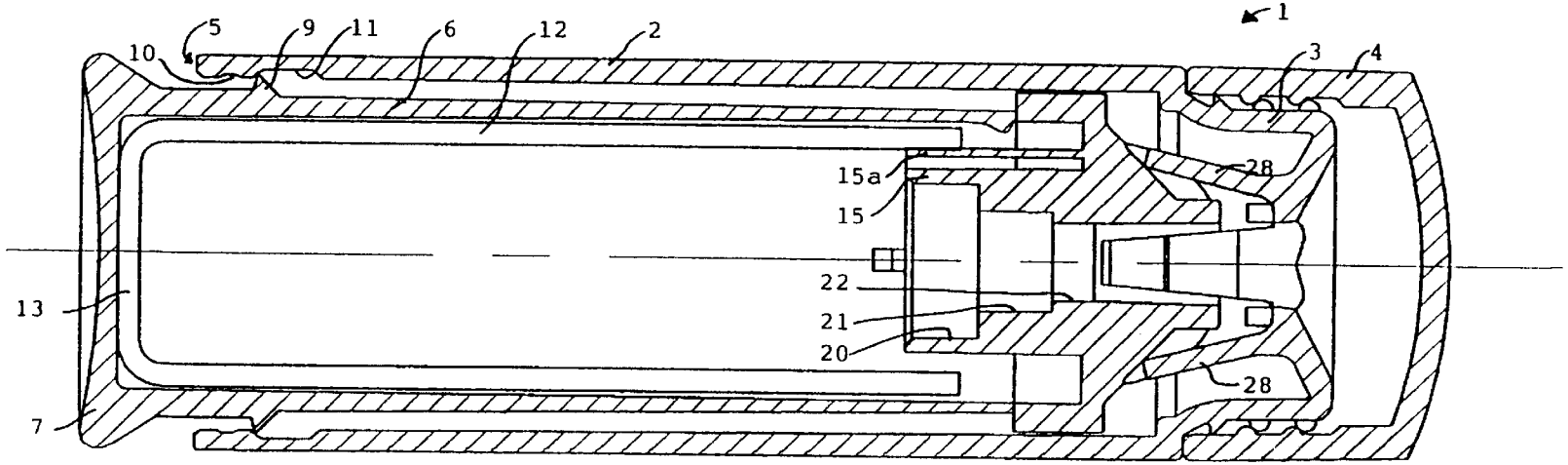
FIG. 2 is a longitudinal cross-sectional view of the dispenser of FIG. 1 with the section being at a right angle to that of FIG. 1.

The sleeve 3 also has two internally projecting spring arms 28 which project inwards from the neck 3 as shown in FIGS. 2 and 3*b*.

It will be appreciated that the sleeve 2 and the plug 14 can each be moulded as a single piece which includes the various components such as the gate 25 and cam surface 23 needed for the dispenser 1 to operate.

In the assembled dispenser, the glass tube 12 is filled with pills (not shown). The glass tube 12 is held within the button 6 by the outlet plug 14, with the glass tube 12 fitting over the first collar 15 and the button 6 sitting against the face 16a of the second collar 16 of the plug 14.

The subassembly of the button 6, tube 12 and plug 14 is then inserted into the end 5 of the sleeve 2 opposite the neck 3 so that the annular rib 9 on the button 6 sits in the transit recess 10. For transport and storage, the open end of the neck 3 of the sleeve 2 can be sealed with an appropriate thin seal of aluminium or plastics for example. This serves to keep the contents of the tube 12 clean and sterile and also acts as a tamper-evident device. The cap 4 can be screwed onto the neck 3 of the sleeve 2. An outer tamper-evident seal, of plastics or aluminium foil for example, can be wrapped around the cap 4 and the sleeve 2. The cap 4 is sealed against the sleeve 2 by means of an annular ring 29 on the neck 3 of the sleeve 2. The dispenser 1 is then ready for transport and storage.

To use the dispenser 1, the cap 4 is unscrewed (which breaks the outer seal if provided). Any inner seal is removed from the neck 3 of the sleeve 2. The cap 4 can then be replaced if desired depending on whether or not the user wishes to dispense pills into the cap 4. The button 6 is pushed further into the sleeve 2 so that the rib 9 passes out of the annular recess 10 and into the operation groove 11. In this position, the free ends of the return springs 28 bear against the plug 14, thereby ensuring that the subassembly of the button 6, tube 12 and plug 14 is constantly biassed away from the neck 3 with the annular rib 9 of the button 6 sitting in the portion of the operation groove 11 which is furthest away from the neck 3.

To dispense a pill, the dispenser 1 is inverted so that the neck 3 and cap 4 are lowermost. The button 6 is fully depressed so that the subassembly of the button 6, the tube 12 and the plug 14 is moved towards the neck 3 of the sleeve 2 against the bias of the return springs 28. When the button 6 is pressed sufficiently far, the tip 26 of the gate arm 25 comes into contact with the cam surface 23 on the plug 14 and follows the cam 23 as the button 6 is pressed further into the sleeve 2. The cam surface 23 therefore flexes the gate arm 25 away from the centre line 24 of the dispenser 1. This movement of the gate arm 25 allows a pill in the outlet 19 to pass from the outlet 19 through the open part of the neck 3. In some circumstances, it may be appropriate for the cap 4 to have first been removed to allow a pill to be dispensed directly into some receptacle or perhaps straight into the user's mouth. On the other hand, it may be more convenient or even essential to leave the cap 4 in position on the neck 3 so that a pill is dispensed into the cap 4; the cap 4 can then be unscrewed from the sleeve 2 and the pill in the cap 4 then transferred directly to the user's mouth from the cap 4, thus avoiding any contact between the user's fingers and the pill dispensed.

As mentioned above, the use of the steps 20,21,22 of decreasing diameter to define a stepped funnel in the plug 14 prevents pills jamming on the way to the outlet 19. Jamming of pills can be a particular problem where the outlet is a conventional smooth taper as mentioned above. The use of a stepped funnel, is particularly useful in stopping this type of jamming as stable locking patterns of pills in the funnel are prevented.

When the button 6 is pushed fully forwards in the sleeve 2 so that the gate arm 25 is fully opened and a first pill has passed out of the neck 3, it will be appreciated, particularly from a study of FIG. 1, that the curved portion 18 of the wall of the plug 14 which defines in part the outlet 19 moves past the abutment surface 27 on the sleeve 2. Thus, the abutment surface 27 moves relatively into the outlet 19, which prevents any further pills being dispensed. Thus, in the preferred embodiment of the present invention, the use of the gate 25 to selectively open the outlet 19 and the abutment surface 27 which moves into the outlet 19 together ensure that one and only one pill is dispensed on operation of the dispenser 1.

When the button 6 is released, the return springs 28 bias the subassembly of the button 6, the tube 12 and the plug 14 away from the neck 3. This allows the gate 25 to relax back to its rest position at which it effectively closes the outlet 19 to prevent pills from passing out of the outlet 19 and the dispenser 1 and thus prevents pills being inadvertently dispensed. The dispenser 1 can then be returned to its upright position with the neck 3 uppermost and the cap 4 replaced.

An embodiment of the present invention has been described with particular reference to the example illustrated. However, it will be appreciated that variations and modifications may be made to the example described within the scope of the present invention.

What is claimed is:

1. A pill dispenser for dispensing pills, the dispenser comprising:

a container for holding pills, the container being closed at one end and open at an opposite end;

a sleeve in which the container is slidably received;

an outlet through which a pill can pass from the container;

a passage from the container to the outlet comprising a stepped funnel having a plurality of steps of decreasing diameter from the container to the outlet; and a gate for closing the outlet to prevent a pill passing through the outlet; the gate being disposed such that the gate is opened when the container is moved in the sleeve whereby a pill can pass through the open end of the container to the outlet to be dispensed from the dispenser.

2. A dispenser according to claim 1, wherein the gate is carried by the sleeve.

3. A dispenser according to claim 1, wherein the gate is a resilient flexible arm.

4. A dispenser according to claim 1, comprising a cam which biases the gate to its open position when the container is moved towards the outlet end of the dispenser to allow a pill to pass to and through the outlet.

5. A dispenser according to claim 1, comprising a stop for preventing second and further pills being dispensed after a first pill has moved past the stop.

6. A dispenser according to claim 5, wherein the stop comprises an abutment which projects into the outlet.

7. A dispenser according to claim 1, wherein the container has an external annular rib which is received in an internal retaining groove in the sleeve for movement therein as the container is moved back and forth in the sleeve.

8. A dispenser according to claim 7, wherein the sleeve has an internal annular recess in which the annular rib may be received when the dispenser is not in use.

9. A dispenser according to claim 1, comprising an outlet plug which is received in the open end of the container.

10. A dispenser according to claim 9, and comprising a cam which biases the gate to its open position when the container is moved towards the outlet end of the dispenser to allow a pill to pass to and through the outlet, wherein the cam is carried by the plug.

11. A dispenser according to claim 1, comprising biasing means for biasing the container away from the outlet.

12. A dispenser according to claim 1, comprising a cap for fitting to a neck of the dispenser.

13. A dispenser according to claim 12, wherein the dispenser is arranged to dispense a pill directly into the cap.

14. A dispenser according to claim 1, wherein the container includes a tube therein.

15. A dispenser according to claim 14, comprising an outlet plug which is received in the open end of the container, wherein the plug comprises a first collar received in the tube.

16. A dispenser according to claim 15, wherein the collar has at least one projecting fin for cushioning the tube.

17. A pill dispenser for dispensing pills, the dispenser comprising:

a container for holding pills, the container being closed at one end and open at an opposite end;

a sleeve in which the container is slidably received;

an outlet through which a pill can pass from the container;

a gate for closing the outlet to prevent a pill passing through the outlet, the arrangement being such that the gate is opened when the container is moved in the sleeve so that a pill can pass through the open end of the container to the outlet to be dispensed from the dispenser; and a stop for preventing second and further pills being dispensed after a first pill has moved past the stop;

wherein the stop is carried by the sleeve so that the stop moves into the outlet when the container is moved in the sleeve towards the outlet end of the dispenser.

18. A dispenser according to claim 17, wherein the passage from the container to the outlet comprises a stepped funnel having a plurality of steps of decreasing diameter from the container to the outlet.

19. A pill dispenser for dispensing pills, the dispenser comprising:

a container for holding pills, the container being closed at one end and open at an opposite end;

a sleeve in which the container is slidably received;

an outlet through which a pill can pass from the container;

a gate for closing the outlet to prevent a pill passing through the outlet, the gate being a resilient flexible cantilever arm; and, a cam which biases the gate to its open position when the container is moved in the sleeve towards the outlet end of the dispenser so that a pill can pass through the open end of the container to the outlet to be dispensed from the dispenser.

20. A dispenser according to claim 19, wherein the gate is carried by the sleeve.

21. A dispenser according to claim 19, comprising a stop for preventing second and further pills being dispensed after a first pill has moved past the stop.

22. A dispenser according to claim 21, wherein the stop comprises an abutment which projects into the outlet.

23. A dispenser according to claim 21, wherein the stop is carried by the sleeve so that the stop moves into the outlet when the container is moved in the sleeve towards the outlet end of the dispenser.

24. A pill dispenser for dispensing pills, the dispenser comprising:

a container for holding pills, the container being closed at one end and open at an opposite end;

a sleeve in which the container is slidably received;

an outlet through which a pill can pass from the container;

a gate for closing the outlet to prevent a pill passing through the outlet, the arrangement being such that the gate is opened when the container is moved in the sleeve so that a pill can pass through the open end of the container to the outlet to be dispensed from the dispenser; and biasing means for biasing the container away from the outlet;

wherein the biasing means comprises a resilient return spring carried by the sleeve.

25. A pill dispenser for dispensing pills, the dispenser comprising:

a container for holding pills, the container being closed at one end and open at an opposite end;

a sleeve in which the container is slidably received;

an outlet through which a pill can pass from the container;

a gate for closing the outlet to prevent a pill passing through the outlet; the arrangement being such that the gate is opened when the container is moved in the sleeve so that a pill can pass through the open end of the container to the outlet to be dispensed from the dispenser; and an outlet plug which is received in the open end of the container;

wherein the passage from the container to the outlet comprises a stepped funnel having a plurality of steps of decreasing diameter from the container to the outlet, wherein the plug provides the stepped funnel to the outlet.

* * * * *